United States Patent [19]

Ansorge

[11] 4,356,940

[45] Nov. 2, 1982

[54] APPARATUS FOR DISPENSING MEASURED AMOUNTS OF MOLTEN METAL

[75] Inventor: Al Ansorge, Mentor, Ohio

[73] Assignee: Lester Engineering Company, Cleveland, Ohio

[21] Appl. No.: 179,113

[22] Filed: Aug. 18, 1980

[51] Int. Cl.[3] ..... B22D 39/02

[52] U.S. Cl. ..... 222/596; 222/63

[58] Field of Search ..... 164/133, 457, 155; 222/52, 63, 26, 595, 596, 385

[56] References Cited

U.S. PATENT DOCUMENTS

| | | | |
|---|---|---|---|
| 3,708,088 | 1/1973 | Lesher | 222/595 |
| 3,797,808 | 3/1974 | Ma et al. | 222/63 X |
| 3,876,191 | 4/1975 | Lauersdorf | 222/595 X |
| 3,888,388 | 6/1975 | Mahoney | 222/63 X |
| 3,889,849 | 6/1975 | Chandler, Jr. | 222/63 |
| 3,904,078 | 9/1975 | Neff et al. | 222/63 X |
| 4,078,706 | 3/1978 | Hanuszczak | 222/596 |

*Primary Examiner*—David A. Scherbel
*Attorney, Agent, or Firm*—Meyer, Tilberry & Body

[57] ABSTRACT

Apparatus for dispensing measured amounts of molten metal to a metal casting operation which is automatic in operation and capable of delivering extremely accurately controlled amounts of metal to the casting operation. A positive displacement pump delivers the molten metal from below the surface of the metal to a dispensing point and a pulse generator generates pulses in exact proportion to the displacement of the pump and delivers such pulses to counters, the counters being started in operation when the metal being pumped contacts a probe at the dispensing point, the counters stopping the pump when an exact amount of displacement of the pump has occurred. Rate multipliers are provided between the pulse generator and the counters to compensate for leakage in the pump, variations in volume delivered for a given displacement of the pump or other unanticipated variables.

10 Claims, 1 Drawing Figure

APPARATUS FOR DISPENSING MEASURED AMOUNTS OF MOLTEN METAL

Figure 1:
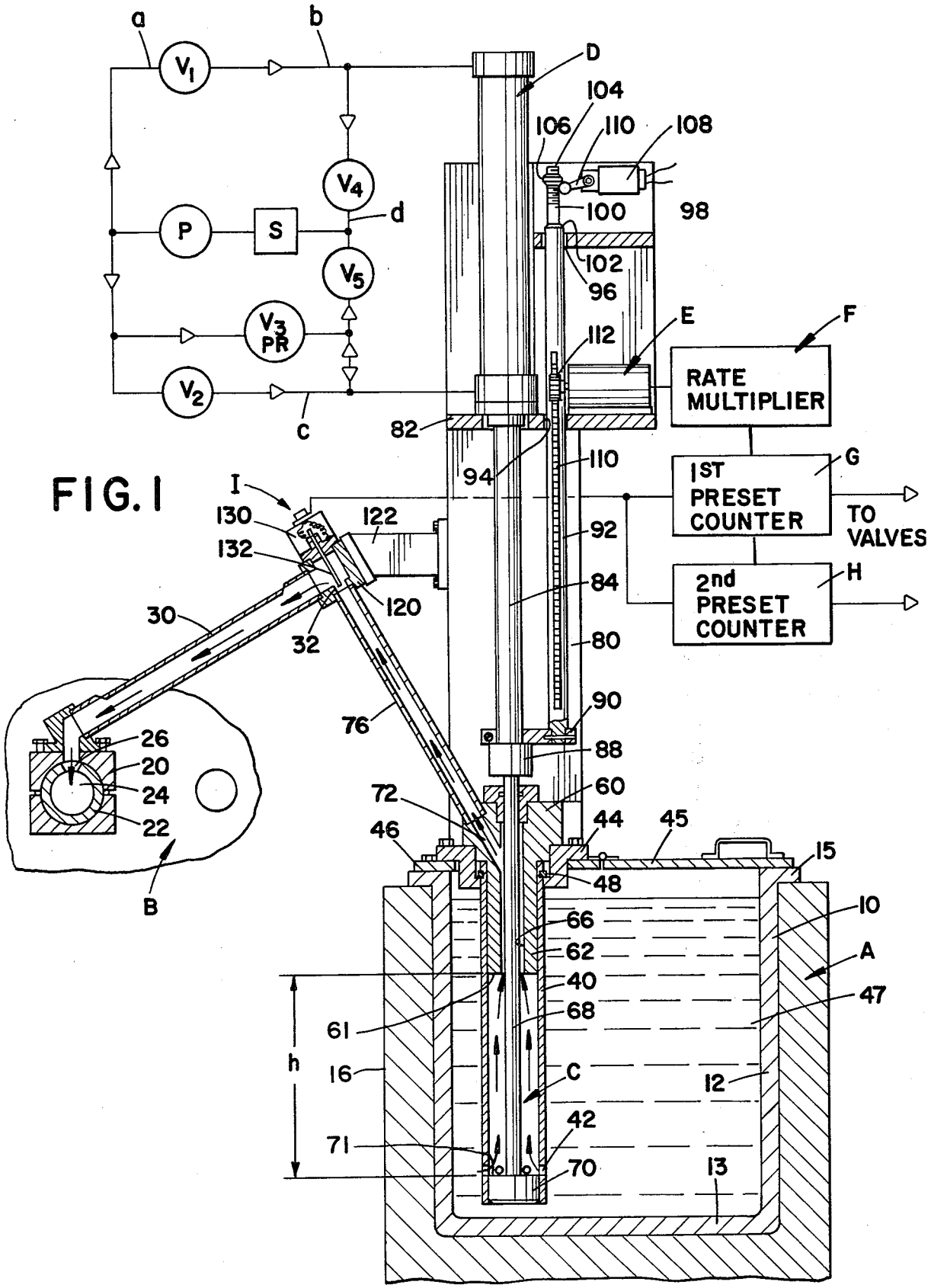

This invention pertains to the art of metal casting and, more particularly, to apparatus for dispensing exactly measured amounts of molten metal to an end point of use.

The invention is particularly applicable to the art of metal die casting of aluminum and will be described with particular reference thereto although it will be appreciated that the invention has other and broader applications particularly in the dispensing of any type of molten metal or the like.

BACKGROUND OF THE INVENTION

In the art of aluminum die casting, it is necessary that the proper amount of molten metal be delivered to the die casting machine for each casting to be made. If too little metal is delivered, then the casting will have voids and will be defective. If too much metal is delivered, metal can be wasted, splashed around or excessive pressures can be developed in the die cavity resulting in the cavity opening and undesirable burrs or flash developing around the edges of the casting.

Heretofore it has been known to hand ladle the molten aluminum into the die casting apparatus. In such instance, the die castor had a ladle of a specified volume which he dipped into a heated vat of molten aluminum to a depth such that the aluminum scum or dross which forms on the surface of the aluminum will not be present on the top of the metal in the ladle. The ladle is then carried from the vat to the point of use and poured into the die casting machine input chamber.

Such an operation required labor to be present continuously and the handling of the molten metal by hand constituted a hazard for the laborer in the event the metal should be spilled and it was always difficult to accurately deliver exactly the same amount of molten metal to the die casting machine for every casting to be made. Also the pounds of metal which can be handled in a manually held ladle are limited.

It has been proposed to provide mechanical apparatus to perform such a function. Such apparatus heretofore commonly comprising a ladle which is mechanically dipped into the vat of molten metal below the surface so as to avoid the scum or dross on the top thereof and then raised out of the vat and moved across the room to the die casting apparatus. Such apparatus was expensive, cumbersome, complicated and difficult to maintain. Additionally there was always the danger of molten metal being spilled as the open ladle was moving from the vat to the die casting machine. Here again the maximum pounds of metal which can be handled is limited by the mechanical strength of the apparatus.

THE INVENTION

The present invention contemplates a new and improved apparatus which overcomes all of the above-referred-to difficulties and enables extremely accurate amounts of molten metal to be delivered to the point of casting without danger of spilling and without any problems of delivering the scum or dross from the top of the molten aluminum to the point of casting.

In accordance with the present invention, there is provided for use in combination with a vat of molten metal, a positive displacement pump having an inlet below the surface of molten metal in the vat and a discharge extended upwardly from the pump to a dispensing point, a pulse generator generating pulses exactly proportional to the displacement of the pump, a counter for such pulses, operable to stop the pump at any preset count, a rate multiplier between the pulse generator and the counter for changing the proportion of pulses to the displacement of the pump and means sensitive to the presence of molten metal at the dispensing point operable to start the counter as the molten metal is commenced to be dispensed to the casting operation.

Further in accordance with the invention, apparatus of the general type described is provided wherein the pump is comprised of an elongated cylinder extending below the surface of the molten metal having an inlet opening adjacent the lower end thereof and an outlet opening adjacent the upper end thereof and a piston moving from the lower end of the cylinder toward the upper end of the cylinder for displacing molten metal through the outlet opening, the piston being actuated by a hydraulic cylinder and the pulse generator being driven by a pinion gear engaging a rack movable with the pump piston.

Further in accordance with the invention, a pair of counters are employed, one to determine the exact amount of molten metal to be delivered and the other to slow down the rate of delivery at a preset volume just less than the maximum volume to be delivered.

OBJECTS

The principal object of the invention is the provision of a new and improved apparatus for dispensing accurate amounts of molten metal which is simple in construction, economical to manufacture and enables extremely accurate amounts of molten metal to be delivered to a casting point on a repetitive basis.

Another object of the invention is the provision of a new and improved apparatus for dispensing accurate amounts of molten metal to a point of casting including a positive displacement pump, means measuring the amount of displacement of the pump and stopping the pump when a preset displacement of the pump has taken place and other means sensitive to the presence of molten metal at the dispensing point for starting the measuring means when molten metal moved by the pump reaches the dispensing point.

Another object of the invention is the provision of a new and improved apparatus for dispensing accurate amounts of molten metal to a point of casting of the general type described wherein means are provided for slowing down the rate of delivery of the fluid just prior to the apparatus having delivered the actual desired amount of molten metal.

Another object of the invention is the provision of apparatus wherein the volume or weight handling capabilities can be readily changed with a minimum amount of effort.

DRAWINGS

The invention may take physical form in certain parts and arrangements of parts, a preferred embodiment of which will be described in detail in this specification and illustrated in the accompanying drawings wherein:

FIG. 1 is a side view partly in elevation, partly in cross section and partly schematic of apparatus for dispensing measured amounts of molten metal all illustrating a preferred embodiment of the present invention.

PREFERRED EMBODIMENT

Referring now to the drawings wherein the showings are for the purposes of illustrating a preferred embodiment of the invention only and not for the purposes of limiting same, the figure shows a vart A of molten aluminum positioned generally adjacent to a die casting machine B, a positive displacement pump C in the vat A, a hydraulic motor D for powering the pump C, a pulse generator E for generating pulses exactly proportional to the displacement of the pump C, a rate multiplier F, a pair of counters G, H for indicating the actual displacement of the pump C and a probe I for starting the counters G, H when molten metal reaches a dispensing point.

The vat A forms no part of the present invention and is shown relatively conventionally. Normally any vat would include an inner cup 10 of metal such as cast iron, steel or stainless steel or refractory surrounded by means (not shown) for heating the material in the cup and a housing 16 surrounding the heating means for preventing the radiation or transmission of heat into the surroundings. The cup 10 in the embodiment shown has a generally cylindrical side wall 12, a flat bottom 13 and an outwardly flanged upper edge 15, which flange 15 rests on the upper surface of outer housing 16 as shown.

The die casting machine B also forms no part of the present invention and may take any one of a number of different forms. In the drawing only that portion of the die casting machine B is shown which receives molten metal prior to being injected into the cavity of the machine. Thus, in the embodiment shown the die casting machine has a metallic outer frame 20 having a horizontal cylindrical passage, a generally cylindrical refractory lining 22 inside the passage having an internal cavity 24 and an inlet opening 26 in the side through which molten metal can flow into the cavity 24. After the molten metal is in the cavity 24, a ram or plunger (not shown) of the die casting machine will advance through the cavity 24 forcing any molten metal therein into the mold cavity of the die casting machine.

In the embodiment shown, a pipe, tube or trough 30 extends downwardly from a dispensing point 32 for the apparatus to a point immediately over the inlet opening 26. This pipe, tube or trough 30 may take any one of a number of different forms and forms no part of the present invention. In the embodiment shown, it is necessary that the pipe, tube or trough 30 be sloped downwardly so that molten metal will flow from the dispensing point 32 under the force of gravity to the cavity 24. It will be appreciated that it is quite possible that the dispensing point be located immediately at the opening 26 and the pipe, tube or trough 30 is provided simply for the purposes of convenience and inasmuch as all of the molten metal flowing past the dispensing point 32 moves into the cavity 24, its length is unimportant.

The pump C in accordance with the invention is of the positive displacement type. While it may take any one of a number of different forms, in the embodiment of the invention shown it is in the form of a vertically extending cylinder 40 of a metal or other material having a melting point above the melting point of the metal to be dispensed and adjacent the lower end is provided with one or a plurality of inlet openings 42 spaced circumferentially around the lower end and preferably located a short distance above the lower end thereof. The upper end of the cylinder 40 is mounted in an iron ring 44 having a bore through which the upper end of the cylinder 40 extends and an upper flange which rests on a base plate 46 in turn which rests on the upper end of the flange 15. The base plate 46 has a cover 45 hinged thereto to enable the vat A to be filled as the molten metal 47 therein is dispensed.

A lock ring 48 in a groove in the outer upper end of the cylinder 40 holds the cylinder 40 in place in the ring 44. A plug 60 extends downwardly into the upper end of the cylinder 40, which plug has a downwardly facing surface resting on the upper surface of the ring 44 and a cylindrical portion 62 extending into the cylinder 40 and in generally tight contact with the inner walls of the cylinder 40. This plug 60 has a central opening 66 extending therethrough through which a piston rod 68 extends, which piston rod has an outer diameter substantially less than the inner diameter of the opening 66 and which piston rod 68 has a piston 70 on the lower end thereof of a diameter so as to mate with the inner diameter of the cylinder 40. The rod 68 is of a length that when in the full down position, the upper surface 71 of the piston 70 is below inlet openings 42.

The plug 60 has a passage 72 communicating with the space 66 and extending upwardly and outwardly therefrom communicating with a pipe or tube 76 which extends upwardly to and terminates at the dispensing point 32. This tube may be of any kind of metal having a melting poit above that of the melting temperature of the metal to be cast and may have refractory placed therearound so as to prevent the loss of heat from the molten metal passing therethrough.

Extending upwardly from the base plate 46 is a vertical support plate 80 having a horizontal support plate 82 generally midway of its length. The hydraulic cylinder D is mounted on this plate 82 and has a connecting rod 84 extending downwardly and is coupled at its lower end with the upper end of the pump piston rod 68 by any suitable detachable type connecting means indicated generally at 88. Fastened to the lower end of the connecting rod 84 is a plate 90 which has fastened to it a rod 92 which extends upwardly through a guide opening 94 in the plate 82 and through a second guide opening 96 in a support plate 98 fastened to the vertical plate 80. The upper end of the rod 92 has a reduced portion 100 forming a shoulder 102 and this reduced portion 100 is threaded as at 104 and a nut 106 is threaded on thereon. A limit switch 108 is mounted on the upper end of the plate 80 and has an actuating arm 110 which is engaged by the lower surface of the nut 106 or the shoulder 102 as the rod 80 moves upwardly and downwardly.

A rack 110 is mounted on and moves with the rod 80 and in accordance with the invention is engaged by a pinion gear 112 on a signal generator E.

The signal generator E may take a number of different forms but in the preferred embodiment is what may be termed a pulse generator generating a plurality of electrical pulses for each revolution of the pinion gear 112. It may in general be called a rotary digital type signal generator, otherwise known as a rotary pulse generator.

Various such generators may be employed in accordance with the invention but the one preferred is Type RPGH-XXX-X manufactured by Red Lion Controls Company of York, Pa. The pinion 112 in the preferred embodiment has a pitch diameter of 1.5 inches such that for each 4.712 inches of movement of the pump piston 70 the generator will generate 1,200 pulses. This equals 254.65 pulses per inch of movement for the piston 70 or 1 pulse for each 0.0039 inches per pulse. Reference to this will be made hereinafter. The pulse signals are then fed directly into the pulse train rate multiplier F capable of multiplying or dividing the pulses received from the generator E by any desired amount. In the preferred embodiment a model CA510 pulse train rate multiplier manufactured by Red Lion Controls of York, Pa. is employed with multiplier is capable of multiplying the incoming pulse trains by any factor from 0.0001 to 1.49, The function of this rate multiplier will be referred to hereinafter. The multiplied pulses are then fed into counters G, H. the counters G, H count the number of pulses received from the multiplier and when a preset number of pulses have been received, each actuate valves for controlling the flow of hydraulic fluid to the hydraulic cylinder D.

In the preferred embodiment the hydraulic cylinder D is supplied at the upper end with hydraulic fluid from a pump P, hydraulic line a, valve $V_1$ and hydraulic line b and at the lower end from hydraulic line a through valve $V_2$ and hydraulic line c. In addition, hydraulic fluid can be supplied to the lower end of hydraulic cylinder D through valve $V_3$ which is a valve of the pressure regulating type having a reduced flow therethrough relative to valve $V_2$. Return flow from the upper and lower ends of the cylinder D to sump S is through valves $V_4$, $V_5$ and hydraulic line d to sump S. The valve circuitry except for the fact that valve $V_3$ with a limited restricted flow is employed form no part of the present invention and will not be further detailed herein.

Pipes 30, 36 are interconnected by means of an elbow or fitting 120 mounted on a bracket 122 in turn mounted on vertical plate 80, the inner lower corner of the elbow 120 forming the dispensing point 32 for the apparatus. In accordance with the preferred embodiment, a probe 130 is located at the dispensing point 32. This probe can take a number of different forms but in the embodiment shown is a pair of either metal or carbon electrodes 132 extending from the outer end of the elbow 120 to a point immediately adjacent the dispensing point 32. When molten metal forced upwardly through the pipe 76 by the pump C contacts the probes 132, the effect is to close an electrical circuit connected to the counters G, H to start these counters counting pulses.

The counter H is preset to the volume or the weight of molten metal to be delivered to the cavity 24. This can be in cubic inches or centimeters or in ounces or grams. The counter G is normally preset to a value just less than the maximum value of molten metal to be delivered to the die casting machine. This counter when it reaches its preset value functions to close valve $V_2$ and open valve $V_3$ (if valve $V_3$ had not previously been opening) so as to slow the rate of hydraulic fluid suppied to the hydraulic cylinder D and enables the counter H to measure the displacement of pump C to stop the flow of fluid to the hydraulic cylinder when it is flowing at a substantially lower rate. With this arrangement molten metal will be delivered to the dispensing point 32 at a rapid rate until the counter G determines that substantially all of the metal to be delivered has been delivered at which time the rate of delivery is substantially slowed down so that when the second preset counter H reaches its preset value and closes valve $V_3$, the rate of flow is quite slow and the amount of molten metal delivered to the dispensing point can be extremely accurately controlled.

In operation the vat A is at least partially filled with molten aluminum to a level such that the volume of molten metal in the cylinder 40 above the upper edge of the inlet opening 42 and below the lower end 61 of plug 60 is at least in excess of the amount of metal necessary to be applied to the die casting machine B. This volume can readily be determined by the difference between the interior cross sectional area of the cylinder 40 and by the distance h between the upper edges of the openings 42 and the lower surface 61 of the plug 60.

When the dispensing operation is commenced, the piston 70 is in the lowermost position below the openings 42 so that the molten metal will have flowed into the cylinder 40 to a depth equal to that in the vat A. Except for possible leakage between the piston 70 and the cylinder 40, the amount of molten metal delivered by the pump once the piston has moved above the inlet openings 42 will be equal to the upper displacement of the piston 70 in linear units such as inches or centimeters multiplied by the area difference above discussed.

The counters have digital read-out means which can indicate the amount of metal dispensed in either pounds, ounces, kilograms, cubic inches, cubic feet or cubic centimeters. This is done by setting the rate multiplier between the pulse generator and the counter to an appropriate multiplication or division factor and thereafter the counters will read out the amount of metal positively displaced by the pump C when the piston 70 is moved upwardly.

In accordance with the invention, however, the counters are not actuated until such time as the molten metal has flowed upwardly through the tube 76 and comes into contact with the probe 132. When the molten metal reaches this point, it is ready to spill over the dispensing point and flow by gravity into the cavity 24 of the die casting machine B. Thus, the counters do not begin to count until metal has actually begun to be dispensed. In operation, a limit switch indicates that the piston 70 is below the openings 42 and ready to begin pumping molten metal. To start pumping, valves $V_2$ and $V_4$ are opened and valves $V_1$ and $V_5$ are closed admitting hydraulic fluid to the lower end of hydraulic cylinder D. Piston 70 is drawn upwardly. When its upper surface passes the upper edge of inlet ports 42, molten metal is forced upwardly through passages 66 and 76. When the metal reaches the dispensing point 32, it contacts the probe 132 electrically connecting them. This provides a signal which starts the counters G, H. As the piston continues to move upwardly positively displacing molten metal for each unit of distance it moves, the counters accurately count the pulses from the pulse generator as multiplied or divided by the rate multiplier and continue to do so until the value preset on the counter G is reached at which time valve $V_2$ is closed and valve $V_3$ (if not already open) is opened, valve $V_3$ being a pressure regulating valve having a substantially lesser flow rate than that of valve $V_2$. Accordingly, the upward movement of the piston is slowed down and the rate of metal being dispensed over the dispensing point 32 is also slowed down. When the value preset on the counter H is reached, valve $V_3$ is closed and valves $V_1$ and $V_5$ are opened allowing hydraulic fluid to flow into the upper end of the hydraulic cylinder and out from the lower end and back to the sump S. Dispensing of metal immediately stops.

The preset value on counter G is nominally just below the preset value on counter H. This provides a maximum rate of flow for the metal throughout most of the dispensing cycle and maximum accuracy of dispensing because at the time the counter G acts to stop the flow of metal a substantially lower rate of flow.

By the use of the rate multiplier, exactly the same measuring apparatus may be used for different size pumps. Thus, if for example the diameter of cylinder 40 and the piston 70 were doubled from that shown, the amount of molten metal delivered by the pump C per inch of vertical movement of the piston 70 would increase in an amount directly proportional to the increase in the differences between the two cross sectional areas, i.e., four times. By setting the rate multiplier to a rate four times as high, the counters will continue to accurately indicate the amount of molten metal being dispensed.

The following table shows preferred dimensions for the pump C and multiplier settings which enables dispensing from the minimum, e.g. 10 cubic inches or 1.0 pounds of aluminum to 1600 cubic inches or 160 pounds of aluminum on each dispensing operation with a 10 inch maximum stroke.

| Weight of Metal | Volume of Metal | Piston Diameter | Rod Diameter | Rate Mult. |
|---|---|---|---|---|
| 10 | 100 | 3.568 | 1.0 | .1472 |
| 20 | 200 | 5.04 | 1.5 | .2945 |
| 40 | 400 | 7.13 | 2.0 | .5890 |
| 80 | 800 | 10.09 | 2.5 | 1.1780 |
| 160 | 1600 | 14.27 | 3.0 | 1.5079 |

It is to be noted that the piston diameter and the rod diameter are so dimensioned as to deliver the specified or desired maximum amount of molten metal for an active stroke of ten inches. The only thing necessary to do when the piston, the piston rod and its cylinder are changed, is to adjust the rate multiplier to the amount indicated, this amount varying from 0.1472 to 1.5079 as is apparent. If there is leakage around the piston 70, this can be likewise compensated for.

The invention has been described with reference to a preferred embodiment. Obviously modifications and alterations will occur to others upon a reading and understanding of this specification and it is my intention to include all such modifications and alterations insofar as they come within the scope of the appended claims.

Having thus described my invention, I claim:

1. In apparatus adapted to be mounted on a vat at least partially filled with molten metal for dispensing accurately measured amounts of such metal, a positive displacement hydraulic pump having an inlet opening adapted to be positioned substantially below the lowest level of the molten metal to be held by the vat and an outlet opening extending upwardly to a dispensing point, power means for operating said pump, a pulse generator associated with said pump and generating a plurality of pulses directly proportional to the displacement of said pump, a first pulse counter including means for actuating an electrical circuit when said counter reaches a preset value, means associated with said circuit for deactivating said power means, a probe at said dispensing point which provides said counter an electrical signal when molten metal reaches said point, said counter commencing to count when receiving a signal from said probe whereby after molten metal contacts said probe a preset volume of molten metal will be dispensed.

2. The apparatus of claim 1 wherein said apparatus includes a second counter capable of being preset to a desired value less than said first counter and said power means has a fast and a slow speed, said second counter acting to change said power means from a fast to a slow speed at its preset value and said first counter deactivating said power means when it reaches it preset value.

3. The combination of claim 1 wherein a rate multiplier is provided between said pulse generator and said first counter.

4. The combination of claim 2 wherein a rate multiplier is provided between said pulse generator and said first and second counters.

5. The apparatus of claim 1 wherein said power means is a hydraulic piston-cylinder and said positive displacement pump is a cylinder adapted to extend below the surface of the molten metal and a piston movable therein, a rack movable with said piston and said pulse counter having a pinion driven by said rack.

6. The apparatus of claim 5 wherein said apparatus includes a second counter capable of being preset to a desired value less than said first counter and said power means has a fast and a slow speed, said second counter acting to move said power means from a fast to a slow speed at its preset value and said first counter stopping said power means when it reaches its preset value.

7. The combination of claim 6 wherein a rate multiplier is provided between said pulse generator and said first and second counters.

8. The combination of claim 5 wherein a rate multiplier is provided between said pulse generator and said first counter.

9. The apparatus of claim 1 wherein said pump is a cylinder adapted to extend below the surface of molten metal and a piston movable therein, said inlet opening is adjacent the lower end of said cylinder and said power means moves with said piston upwardly to dispense molten metal.

10. The apparatus of claim 9 including a rack movable with said piston and a pinion on said pulse counter engaging said rack.

* * * * *